US008298030B2

(12) United States Patent
Nakayama et al.

(10) Patent No.: US 8,298,030 B2
(45) Date of Patent: Oct. 30, 2012

(54) SPARK PLUG MANUFACTURING METHOD, AND SPARK PLUG

(75) Inventors: Katsutoshi Nakayama, Nagoya (JP); Satoshi Nagasawa, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 54 days.

(21) Appl. No.: 12/532,850

(22) PCT Filed: Mar. 27, 2008

(86) PCT No.: PCT/JP2008/055833
§ 371 (c)(1),
(2), (4) Date: Sep. 24, 2009

(87) PCT Pub. No.: WO2008/123344
PCT Pub. Date: Oct. 16, 2008

(65) Prior Publication Data

US 2010/0109502 A1 May 6, 2010

(30) Foreign Application Priority Data

Mar. 29, 2007 (JP) ..... 2007-087657

(51) Int. Cl.
*H01T 21/02* (2006.01)
*H01T 13/20* (2006.01)

(52) U.S. Cl. ..... 445/7; 313/141

(58) Field of Classification Search ..... 313/141; 445/7

See application file for complete search history.

(56) References Cited

U.S. PATENT DOCUMENTS 5,574,329 A * 11/1996 Kagawa ..... 313/141
RE35,429 E * 1/1997 Kondo ..... 313/141

(Continued)

FOREIGN PATENT DOCUMENTS

| | | |
|---|---|---|
| JP | S55-121290 A | 9/1980 |
| JP | 02-095190 | 7/1990 |
| JP | 5-182743 | 7/1993 |
| JP | 2005-271050 | 10/2005 |

(Continued)

OTHER PUBLICATIONS

The International Bureau of WIPO, International Preliminary Report on Patentability for International Application No. PCT/JP2008/055833, Issued on Oct. 20, 2009.

(Continued)

*Primary Examiner* — Karabi Guharay
*Assistant Examiner* — Michael Santonocito
(74) *Attorney, Agent, or Firm* — Stites & Harbison PLLC; Jeffrey A. Haeberlin; Nicolo Davidson

(57) ABSTRACT

There is provided according to the present invention a manufacturing method of a spark plug that includes a cylindrical metal shell, a cylindrical ceramic insulator retained in the metal shell, a center electrode retained in the ceramic insulator and extending in an axial direction and a ground electrode having a rear end portion fixed to the metal shell and a front end portion formed with a protruding region facing a front end portion of the center electrode with a gap left therebetween and being of substantially uniform thickness except for an area where the protrusion is formed. The spark plug manufacturing method includes a press forming step for pressing the whole of a ground electrode material for constituting the ground electrode, so as to form a protruding region on a front end portion of the ground electrode material and a welding step for, after the press forming step, welding a rear end portion of the ground electrode material to the metal shell.

10 Claims, 8 Drawing Sheets

U.S. PATENT DOCUMENTS

| | | | | |
|---|---|---|---|---|
| 5,990,602 | A | 11/1999 | Katoh et al. | |
| 6,304,022 | B1 | 10/2001 | Matsutani | |
| 6,603,244 | B2 | 8/2003 | Sugiyama et al. | |
| 6,653,767 | B2 | 11/2003 | Morita et al. | |
| 2002/0158559 | A1* | 10/2002 | Sugiyama et al. | 313/141 |
| 2003/0178925 | A1* | 9/2003 | Kumagai et al. | 313/141 |
| 2005/0200255 | A1* | 9/2005 | Yoshimoto et al. | 313/143 |
| 2006/0220511 | A1 | 10/2006 | Hanashi et al. | |

FOREIGN PATENT DOCUMENTS

| | | |
|---|---|---|
| JP | 3115865 | 11/2005 |

OTHER PUBLICATIONS

State Intellectual Property Office of The People's Republic of China, First Office Action for counterpart Chinese Application No. 200880007802.8, issued May 27, 2011.

* cited by examiner

SPARK PLUG MANUFACTURING METHOD, AND SPARK PLUG

TECHNICAL FIELD

The present invention relates to a method of manufacturing a spark plug for use in an automotive internal combustion engine etc. and a spark plug.

BACKGROUND ART

A spark plug is known which include a center electrode and a ground electrode arranged at a discharge gap away from a front end portion of the center electrode so as to generate a spark discharge between the center electrode and the ground electrode for ignition of an air-fuel mixture in a combustion chamber of an internal combustion engine.

Amid recent calls for global environmental protection, it is more strongly demanded to provide energy savings, regulate emissions of carbon dioxide and reduce emissions of unburned gases (hydrocarbon compounds). In order to satisfy these demands, developments are being actively made in internal combustion engines such as lean-burn engine, direct gasoline-injection engine and low emission gas engine. Further, exhaust gas recirculation (EGR) systems, which recirculate a part of exhaust gases into combustion chambers to reduce negative engine loads in intake strokes and produce more cleaner exhaust emissions, are being actively introduced to the lean-burn engines. Under such circumstances, it is required that the spark plug ignites a lean air-fuel mixture containing a large amount of inert exhaust gases. Spark plugs with higher ignition performance are thus needed.

One known type of spark plug with improved ignition performance includes a center electrode having a noble metal tip welded to an electrode body thereof and a ground electrode having a protruding region formed by e.g. welding a cylindrical noble metal tip, with an annular surface of the cylindrical noble metal tip directly facing the noble metal tip of the center electrode, so as to generate a spark discharge between these noble metal tips. There is proposed another type of spark plug in which a ground electrode has a protruding region formed by press forming (See Patent Document 1.)

Patent Document 1: Japanese Laid-Open Patent Publication No. 2006-286469

In the case of forming the protruding region by welding the noble metal tip to the ground electrode, the spark plug attains improved ignition performance but has a problem of increase in manufacturing cost due to the use of the expensive noble metal tip. In the case of press forming the protruding region on the front end portion of the ground electrode after welding the ground electrode to the metal shell, the periphery of the protruding region decreases in thickness to inevitably define a thickness changing region between the pressed part and the unpressed part. This raises a possibility of a ground electrode breakage occurring in the thickness changing region when the ground electrode is bent to a substantially L-shaped form during the manufacturing of the spark plug or when the ground electrode is subjected to external force during the use of the finished plug product. The spark plug thus has a problem of difficulty in securing durability.

DISCLOSURE OF THE INVENTION

The present invention has been made to solve the above problems. It is an object of the present invention to provide a spark plug that combines good ignition performance, economy and durability and a method of manufacturing the spark plug with lower cost than conventional.

According to an aspect of the present invention, there is provided a manufacturing method of a spark plug, the spark plug including: a cylindrical metal shell; a cylindrical ceramic insulator retained in the metal shell; a center electrode retained in the ceramic insulator and extending in an axial direction; and a ground electrode having a rear end portion fixed to the metal shell and a front end portion formed with a protruding region facing a front end portion of the center electrode with a gap left between the protruding region and the front end portion of the center electrode, the ground electrode being of substantially uniform thickness except for an area where the protrusion is formed, the manufacturing method comprising: a press forming step for pressing the whole of a ground electrode material for constituting the ground electrode, so as to form a protruding region on a front end portion of the ground electrode material; and a welding step for, after the press forming step, welding a rear end portion of the ground electrode material to the metal shell.

According to another aspect of the present invention, there is provided a spark plug, comprising: a cylindrical metal shell; a cylindrical ceramic insulator retained in the metal shell; a center electrode retained in the ceramic insulator and extending in an axial direction; and a ground electrode having a rear end portion fixed to the metal shell, a front end portion formed with a protruding region facing a front end portion of the center electrode with a gap left between the protruding region and the front end portion of the center electrode and a noble metal tip joined to a front end of the protruding region via a fused region formed therebetween by laser welding, the ground electrode being of substantially uniform thickness except for an area where the protruding region is formed, wherein the spark plug satisfies the following conditions: $D1<D2$, $L1>L2$ and $P>L2$ where D1 is an outer diameter of the noble metal tip; L1 is a height of the noble metal tip; D2 is an outer diameter of the protruding region; L2 is a height of the protruding region; and P is a height of protrusion of the noble metal tip from the fused region.

In the spark plug manufacturing method of the present invention, the protruding region is formed by press forming on the ground electrode so as to face the center electrode. This makes it possible to provide improvement in ignition performance as in the case of providing a noble metal tip on the ground electrode and possible to manufacture the spark plug at lower cost than in the case of laser welding the noble metal tip to the ground electrode. Further, the ground electrode material is subjected to pressing to form the protruding region and is then welded to the metal shell. This makes it possible to press the whole of the ground electrode material so as not to form a thickness changing region and possible to secure durability without the occurrence of a ground electrode breakage in the thickness changing region.

BEST MODE FOR CARRYING OUT THE INVENTION

Figure 1:
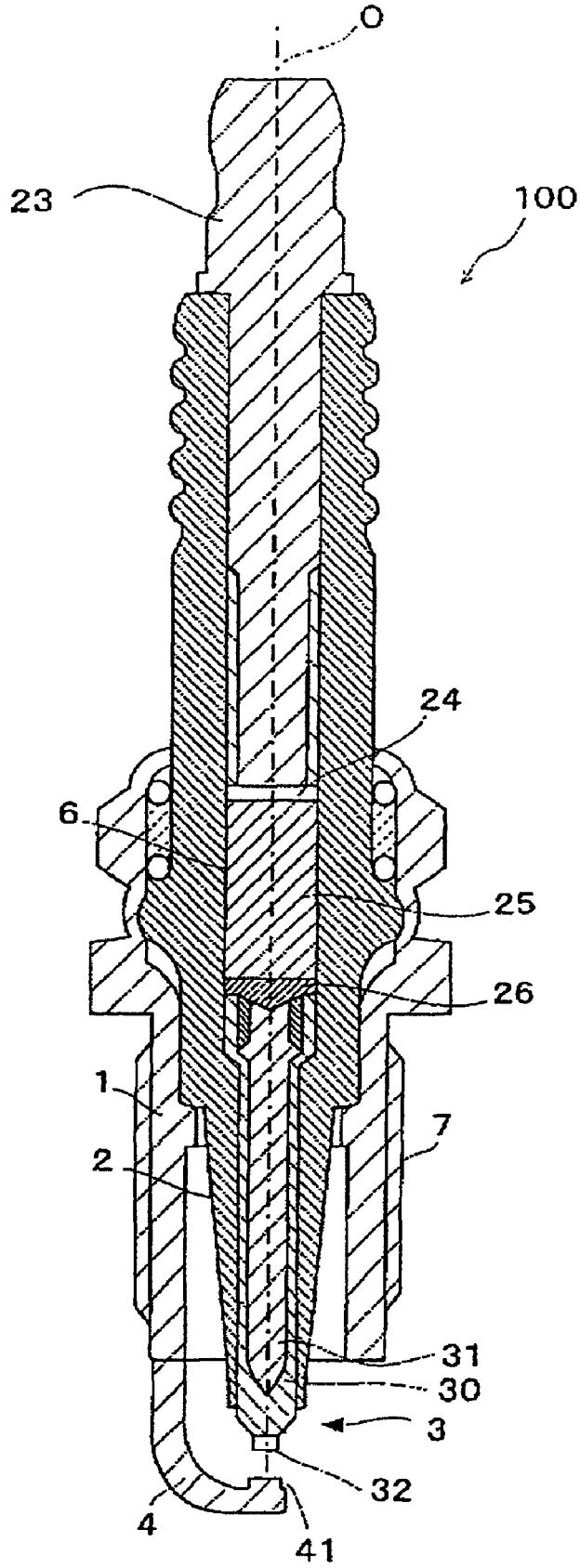
FIG. 1 is a general section view of a spark plug according to one embodiment of the present invention.

The present invention will be described in detail below with reference to the drawings. Herein, like parts and portions are designated by like reference numerals to avoid repeated explanations thereof.

As shown in FIG. 1, a spark plug 100 according to one embodiment of the present invention includes a metal shell 1, a ceramic insulator 2, a center electrode 3 and a ground electrode 4.

The metal shell 1 is made of metal such as low carbon steel and formed into a cylindrical shape. A threaded portion 7 is formed on an outer circumferential surface of the metal shell 1 and adapted for mounting the spark plug 100 onto an engine block (not shown).

The ceramic insulator 2 is made of sintered ceramic such as alumina or aluminum nitride and retained in the metal shell 1 with a front end portion of the ceramic insulator 2 protruding from an end face of the metal shell 1.

A through hole 6 is formed through the ceramic insulator 2 in the direction of an axis O. The center electrode 3 is arranged in a front side (bottom side in the drawing) of the through hole 6 with a front end portion of the center electrode 3 protruding from an end face of the ceramic insulator 2. This center electrode 3 has a center electrode body 30 as a surface layer part and a noble metal tip 32 welded to a front end of the center electrode body 30. The center electrode body 30 is made of Ni-based alloy and formed into a cylindrical column shape. The center electrode 3 also has a thermal conduction enhancing member of Cu or Cu alloy embedded in the electrode body 30. The noble metal tip 3 can be made of Ir-based alloy containing Ir as a main component and 3 to 50 mass % of one or more selected from Pt, Rh, Ru and Re in total as a sub-component to not only limit oxidation/volatilization of Ir but obtain improvement in workability and have a cylindrical column outer shape with a diameter of 0.6 mm. A terminal fitting 23 is arranged in a rear side of the though hole 6 of the ceramic insulator 2 and electrically connected to the center electrode 3 via a radio noise reducing resistor 25 and conductive glass seal layers 24 and 26.

Figure 2:
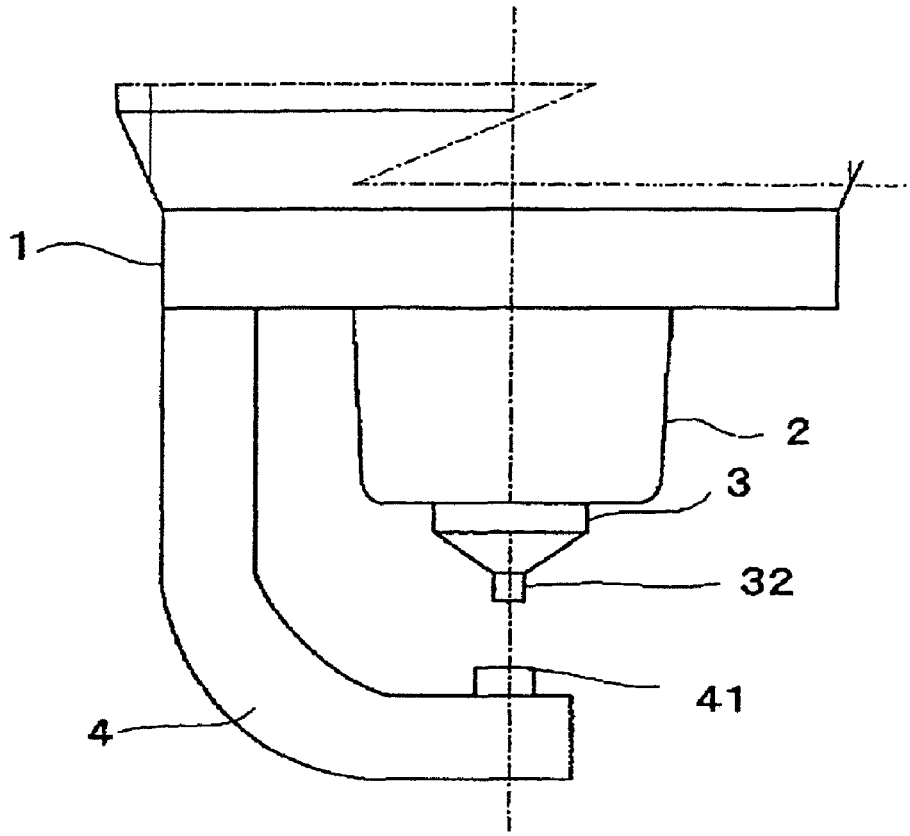
FIG. 2 is an enlarged view of substantial part of the spark plug of FIG. 1.

The ground electrode 4 is bent to a substantially L-shaped form and arranged to have one end portion (rear end portion) thereof joined to the front end face of the metal shell 1 and the other end portion (front end portion) facing a front end of the noble metal tip 32 of the center electrode 3. As is also shown in FIG. 2, this ground electrode 4 includes a column-shaped protruding region 41 facing and protruding toward the noble metal tip 32. In the present embodiment, the protruding region 41 has a cylindrical column outer shape with a diameter of 1.0 mm and a height of 0.3 mm. For improvements in ignition performance and heat resistance and reduction in manufacturing cost, the ground electrode 4 including the protruding region 41 can be made of e.g. Ni-based alloy. The column-shaped protruding region 41 is formed by press forming as will be explained later. The ground electrode 4 except for the protruding region 41 is substantially uniform in thickness.

In the spark plug 100, the column-shaped protruding region 41 is formed by press forming on the ground electrode 4 so as to face the noble metal tip 32 as mentioned above. This protruding region 41 performs the same function as a noble metal tip provided on the ground electrode 4. It is thus possible to provide improvement in ignition performance. It is also possible to avoid the necessity for the expensive noble metal tip and the laser welding process and provide substantial reduction in manufacturing cost as compared with the case of laser welding the noble metal tip to the ground electrode 4. It is further possible to secure durability as the ground electrode 4 is of substantially uniform thickness except for the protruding region 41 and has less distortion remaining due to the bending process.

Although the noble metal tip 32 is provided on the center electrode 3 as shown in FIGS. 1 and 2, the center electrode 3 may alternatively have no noble metal tip 32 for further reduction in manufacturing cost. In this case, the center electrode 3 and the protruding region 41 can be cylindrical column-shaped with a diameter of 2.5 mm and 2.9 mm, respectively.

Figure 3A:
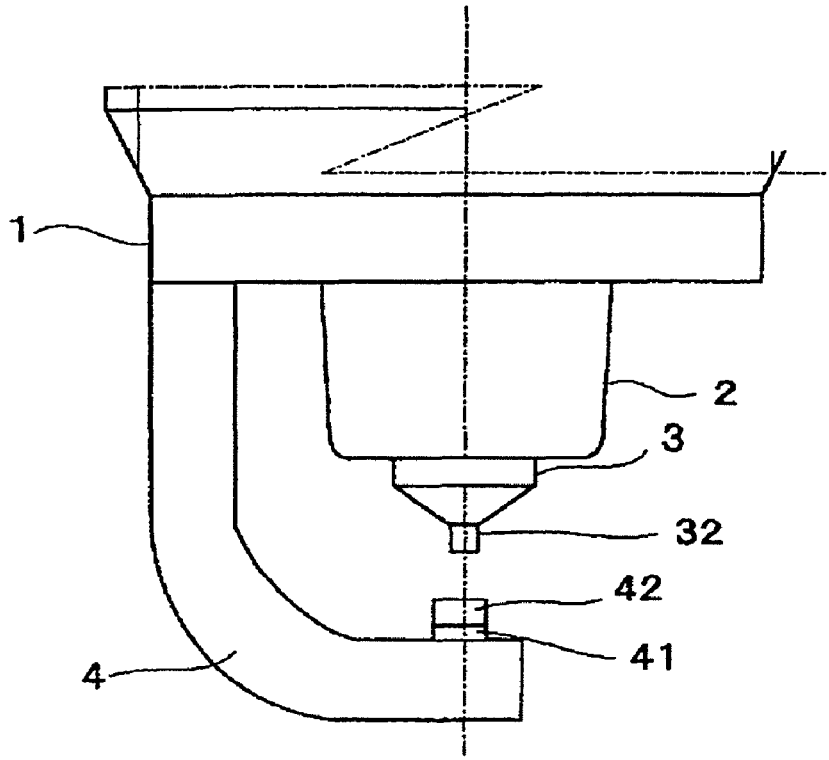
FIG. 3A is an enlarged view of substantial part of a spark plug according to another embodiment of the present invention.
Figure 3B:
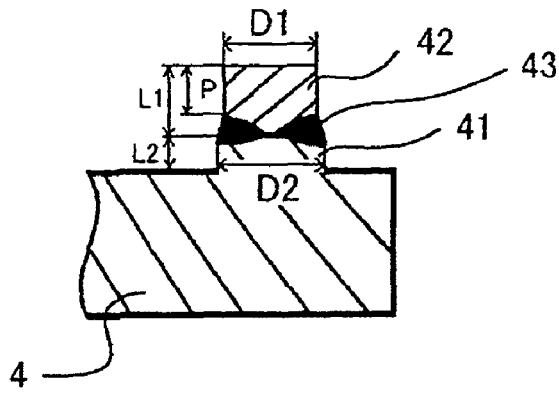
FIG. 3B is a section view of a ground electrode of the spark plug of FIG. 3A.

As shown in FIGS. 3A and 3B, a noble metal tip 42 of e.g. Pt alloy can be further provided on the column-shaped protruding region 41 of the ground electrode 4. This configuration reduces the volume (amount) of the noble metal tip required, as compared with the case of providing the noble metal tip directly on the flat ground electrode 4 without the column-shaped protruding region 41, and increase the protrusion height of the noble metal tip. It is thus possible to provide not only improvements in ignition performance and durability but reduction in manufacturing cost. The noble metal tip 42 and the protruding region 41 of the ground electrode 4 are joined together by laser welding. More specifically, the noble metal tip 42 is first placed on the protruding region 41. The boundary of the protruding region 41 and the noble metal tip 42 is subsequently irradiated with a laser, thereby forming therebetween a fused region 43 in which constituent materials of the protruding region 41 and the noble metal tip 42 are fused together to join the protruding region 41 and the noble metal tip 42.

It is herein defined that D1 is an outer diameter of the noble metal tip 42; L1 is a height of the noble metal tip 42; P is a height of protrusion of the noble metal tip 42 from the fused region 43; D2 is an outer diameter of the protruding region 41;

and L2 is a height of the protruding region 41. When the outer diameter D1 of the noble metal tip 42 is set smaller than the outer diameter D2 of the protruding region (D1<D2), it is possible to provide improvements in ignition performance and welding strength of the noble metal tip 42 and the protruding region 41. It is further possible to ensure a sufficient width of the fused region 43 while securing a sufficient height P of protrusion of the noble metal tip 42 from the fused region 43 and thereby possible to provide further improvements in ignition performance and welding strength of the protruding region 41 and the noble metal tip 42 when each of the height L1 of the noble metal tip 42 and the height P of protrusion of the noble metal tip 42 from the fused region 43 is set larger than the height L2 of the protruding region 41 (L1>L2, P>L2). For example, the outer diameter D1 of the noble metal tip 42, the height L1 of the noble metal tip 42, the protrusion height P of the noble metal tip 42 from the fused region 43, the outer diameter D2 of the protruding region 41 and the height L2 of the protruding region 41 can be set to 0.7 mm, 0.6 mm, 0.4 mm, 1.2 mm and 0.3 mm, respectively.

Figure 4:
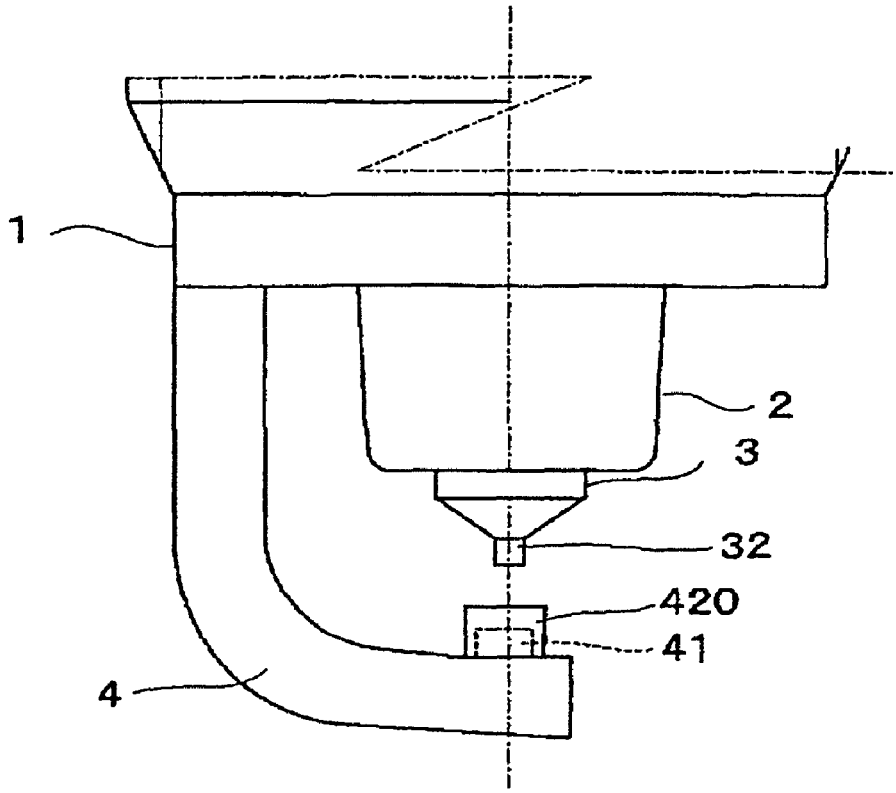
FIG. 4 is an enlarged view of substantial part of a spark plug according to still another embodiment of the present invention.
Figure 5:
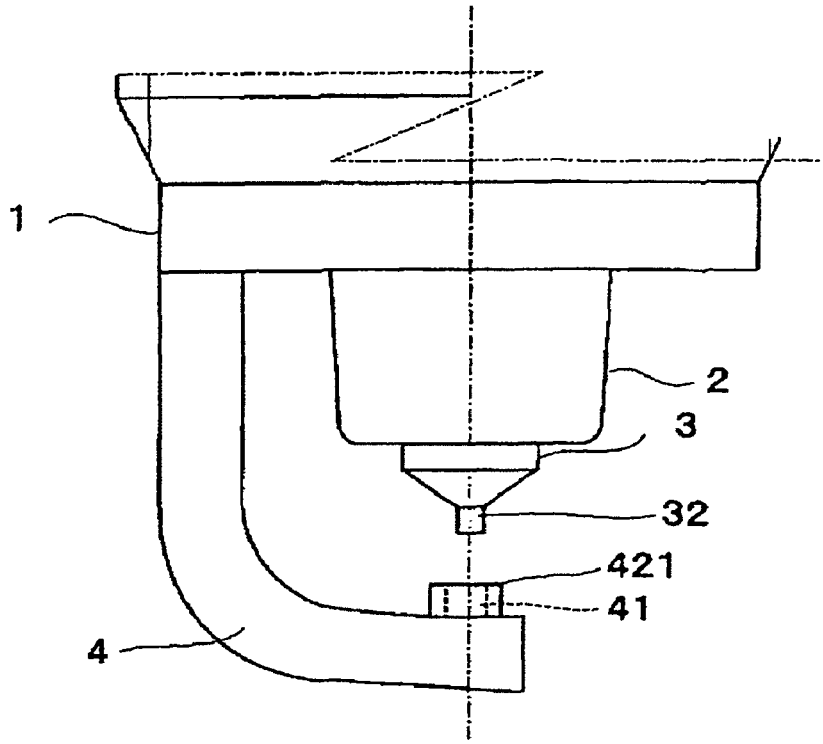
FIG. 5 is an enlarged view of substantial part of a spark plug according to yet another embodiment of the present invention.

Alternatively, a noble metal tip 420 with a recess in a bottom thereof may be used by fitting the column-shaped protruding region 41 in the recess of the noble metal tip 420 as shown in FIG. 4. As shown in FIG. 5, an annular noble metal tip 421 with a center circular hole may alternatively be used by fitting the column-shaped protruding region 41 in the circular hole of the noble metal tip 421.

An explanation will be given of a manufacturing method of the spark plug 100 with reference to FIG. 6.

Figure 6:
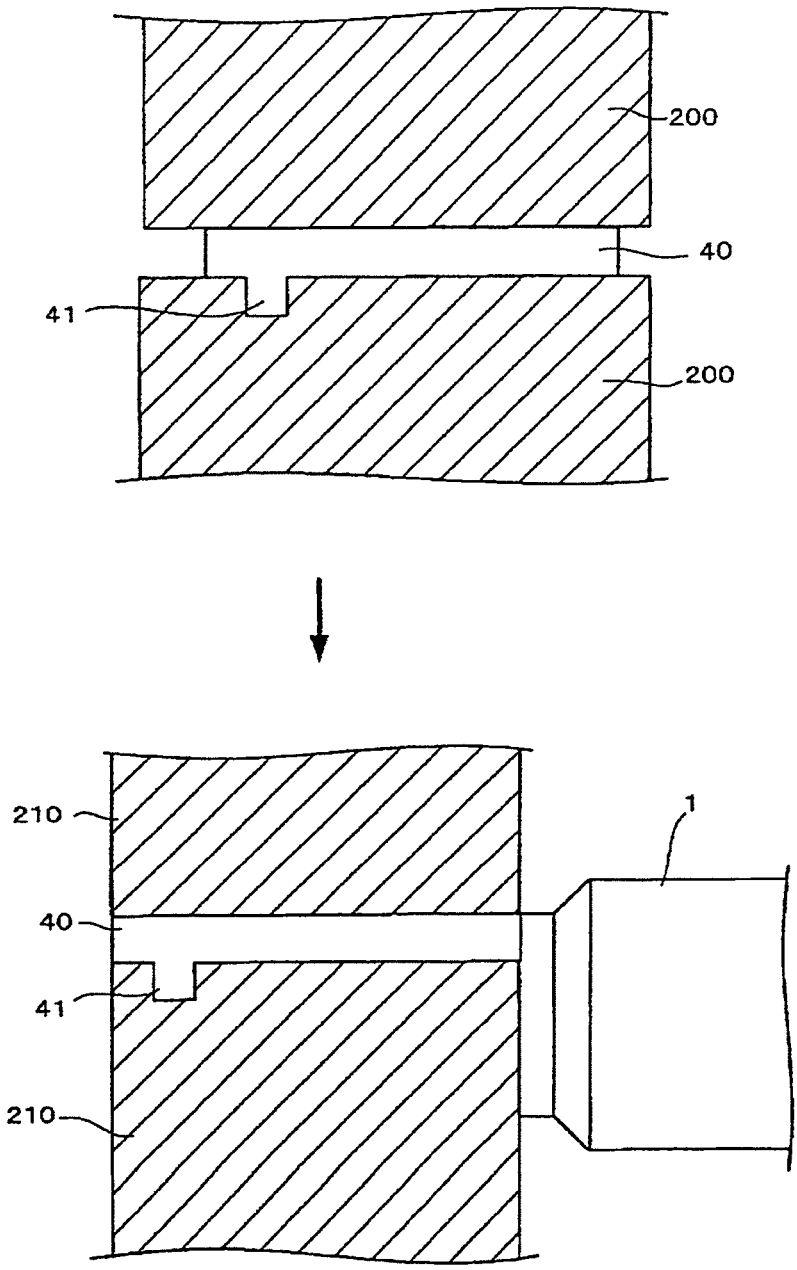
FIG. 6 is a schematic view showing a spark plug manufacturing method (a press forming process step and a welding process step) according to one embodiment of the present invention.

As shown in an upper side of FIG. 6, a ground electrode material 40 for production of the ground electrode 4 is first subjected to press forming using a press die 200, thereby forming the protruding region 41 of given shape at a given position on the ground electrode material 40. At this time, the whole of the ground electrode material 40 is subjected to pressing so as not to form any different thickness region or regions other than the protruding region.

The ground electrode material 40 with the protruding region 41 is then cut to a given length. After that, the ground electrode material 40 is transferred from the press die 200 to a welding jig 210 and welded at a rear end portion thereof to the front end of the metal shell 1 as shown in a lower side of FIG. 6.

The ground electrode material 40 is bent to a substantially L-shaped form, thereby forming the ground electrode 4 as shown in FIG. 1.

For example, in the case of press forming the protruding region 41 after welding the ground electrode material 40 to the metal shell 1, some part of the ground electrode material 40 at or adjacent to the welded joint between the ground electrode material 40 and the metal shell 1 cannot be pressed. This results in a thickness changing region, in which the ground electrode material 40 changes in thickness, being formed between the unpressed rear end part and the pressed front end part of the ground electrode material 40. When such a thickness changing region is formed on the ground electrode material 40, there arises a high possibility of a ground electrode breakage in the thickness changing region at the time the ground electrode material 40 is bent to a substantially L-shaped form or is subjected to external force during the use of the finished product.

In the present embodiment, by contrast, the ground electrode material 40 is welded to the metal shell 1 after press forming the protruding region 41 on the ground electrode material 40. This allows the whole of the ground electrode material 40 to be pressed without forming any different thickness region or regions (thickness changing region or regions) other than the protruding region 41. It is accordingly possible to secure durability without the occurrence of a ground electrode breakage in the thickness changing region or regions. Further, the press forming of the column-shaped protruding region 41 on the ground electrode 4 enables mass production in a short time as compared with the case of laser welding the noble metal tip to the ground electrode 4. There is no need for the expensive noble metal tip. It is thus possible to provide substantial reduction in manufacturing cost.

There is a case where it becomes difficult to bend the ground electrode material 40 to a substantially L-shaped form as the hardness of the ground electrode material 40 increases by work hardening during the press forming process. In this case, it is feasible to anneal the ground electrode material 40 after the press forming process for ease of the subsequent process of bending the ground electrode material 40 to a substantially L-shaped form. Only the ground electrode material 40 can be subjected to annealing when the ground electrode material 40 is annealed before welded to the metal shell 1. This makes it possible to manufacture the spark plug 100 efficiently for reduction in manufacturing cost.

Figure 7:
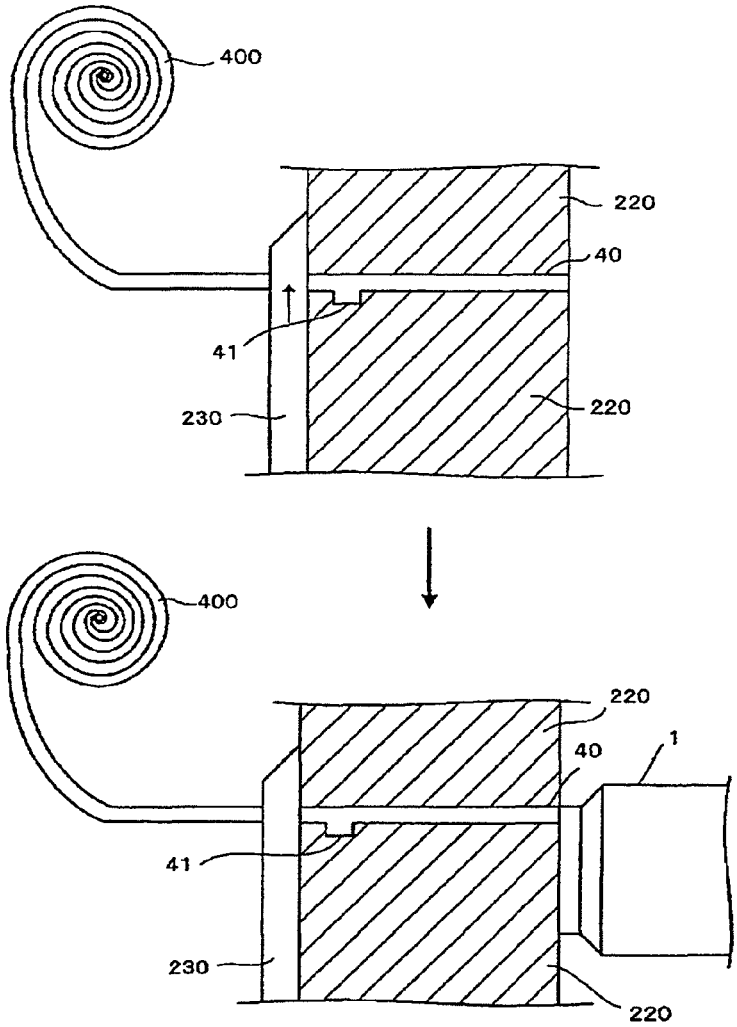
FIG. 7 is a schematic view showing a spark plug manufacturing method (a press forming process step and a welding process step) according to another embodiment of the present invention.

An explanation will be given of a spark plug manufacturing method according to another embodiment of the present invention with reference to FIG. 7. In the present embodiment, a ground electrode material 40 is supplied from a coiled wire material source 400 and then subjected to press forming by a press die 200 to form the protruding region 41 simultaneously with being cut to a given length by a cutting tool 230 as shown in an upper side of FIG. 7. Next, the ground electrode material 40 formed with the protruding region 41 and cut to the given length is fixed by welding to the front end of the metal shell 1 in a state of being held by the press die 200 and thereby using the press die 200 as a welding jig. After that, the ground electrode material 40 is bent to a substantially L-shaped form, thereby forming the ground electrode 4 as shown in FIG. 1. The use of the ground electrode material 40 supplied by cutting the wire material to the given length allows efficient manufacturing of the spark plug 100 for reduction in manufacturing cost. There is no need for the transferring process between the press forming process and the welding process as the ground electrode material 40 is welded to the front end of the metal shell 1 in the state of being held by the press die 200. It is thus possible to manufacture the spark plug 100 more efficiently for reduction in manufacturing cost.

Although the form of the column-shaped protruding region 41 is not particularly restricted, it is preferable that the protruding region 41 has a cross section area of 0.1 $mm^2$ to 6.6 $mm^2$ in a direction perpendicular to the axis direction for compatibility between ignition performance and durability.

Figure 8:
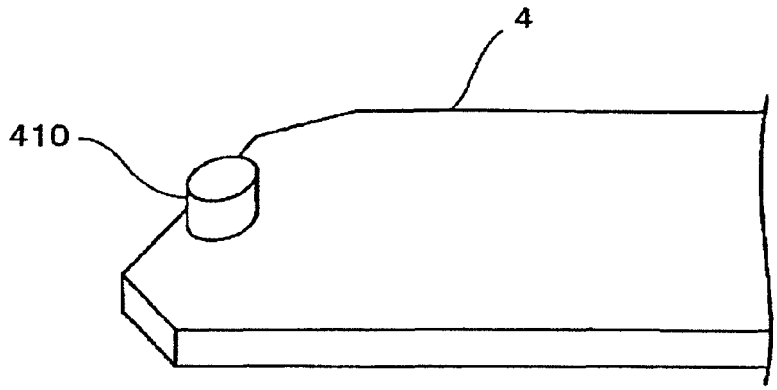
FIG. 8 is a modification of a ground electrode protruding region of the spark plug according to the embodiment of the present invention.
Figure 9:
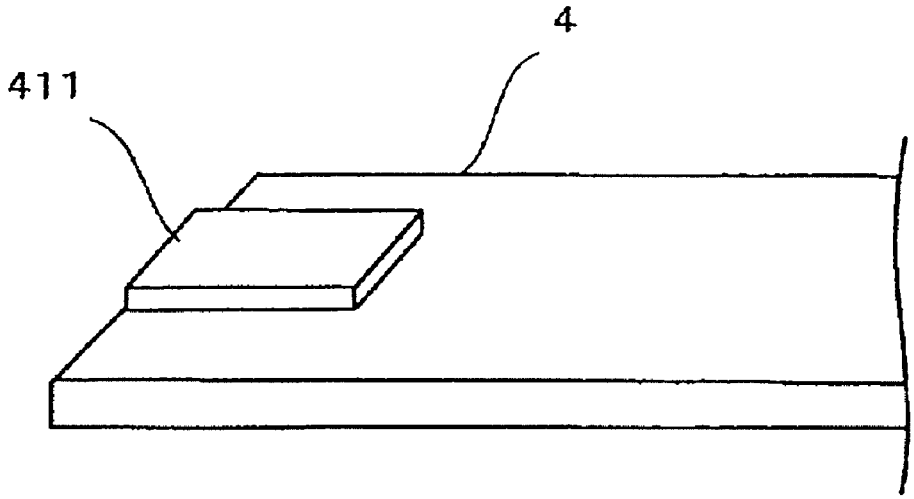
FIG. 9 is a modification of a ground electrode protruding region of the spark plug according to the embodiment of the present invention.
Figure 10:
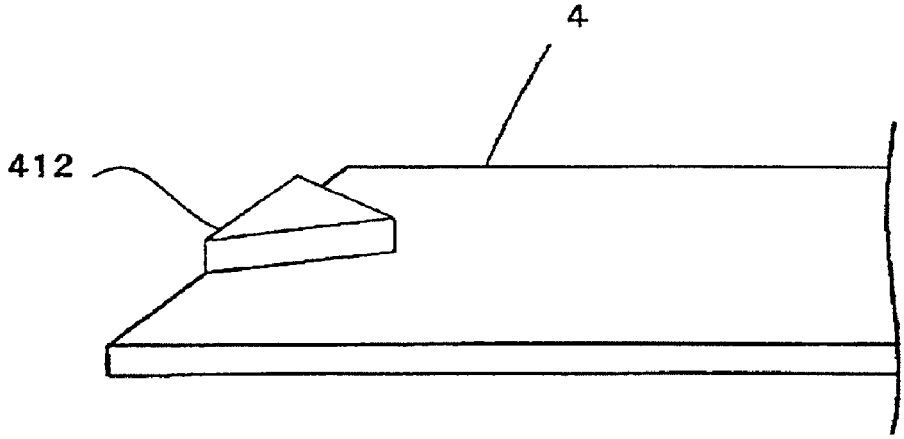
FIG. 10 is a modification of a ground electrode protruding region of the spark plug according to the embodiment of the present invention.
Figure 11:
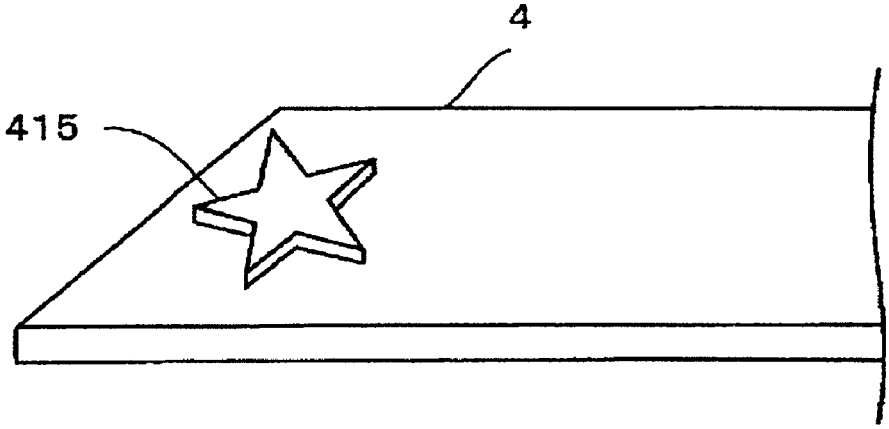
FIG. 11 is a modification of a ground electrode protruding region of the spark plug according to the embodiment of the present invention.
Figure 12:
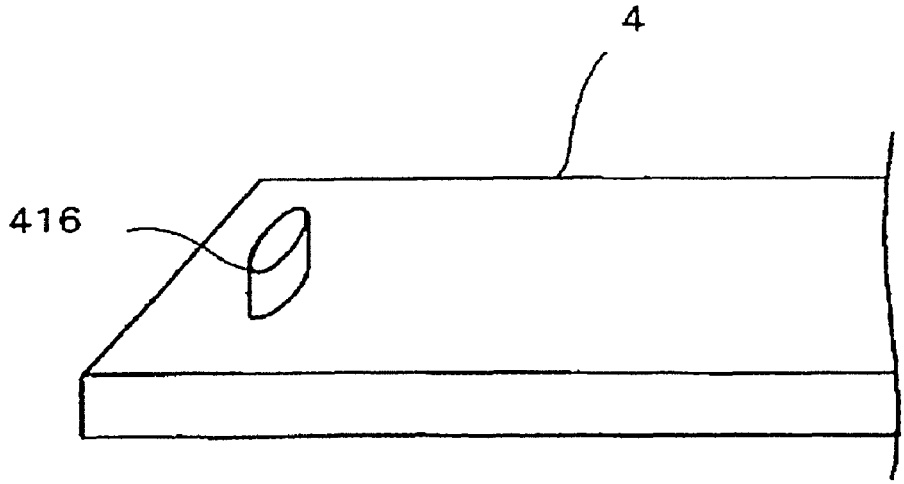
FIG. 12 is a modification of a ground electrode protruding region of the spark plug according to the embodiment of the present invention.
Figure 13:
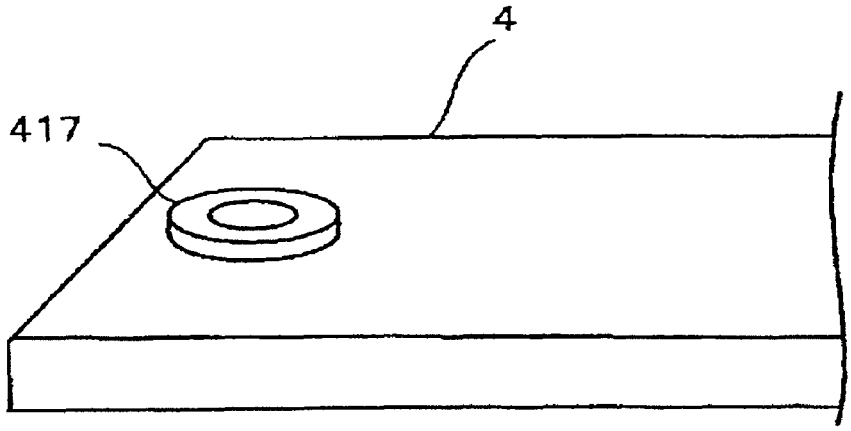
FIG. 13 is a modification of a ground electrode protruding region of the spark plug according to the embodiment of the present invention.

For example, modifications can be made to the column-shaped protruding region 41 as shown in FIGS. 8 to 13. In the modification of FIG. 8, a cylindrical column-shaped protruding region 410 is formed on the front end portion of the ground electrode 4 with both of lateral corners of the front end of the ground electrode 4 being cut away. In the case of processing the ground electrode 4 into the shape that both of the lateral edges of the front end of the ground electrode 4 are cut away as shown in FIG. 8, it is preferable to perform such shaping process after press forming the protruding region 41 on the ground electrode 4. This allows the front end portion of the ground electrode 4 to be processed into any desired shape. In the modification of FIG. 9, a square column-shaped protruding region 411 is formed on the front end portion of the ground electrode 4. In the modification of FIG. 10, a triangular column-shaped protruding region 412 is formed on the front end portion of the ground electrode 4. In the modification of FIG. 11, a protruding region 415 is provided in the form of a star-shaped column at a position slightly rearward from the front end edge of the ground electrode 4. In the modification of FIG. 12, an elliptic cylinder-shaped protruding region 416 is formed at a position slightly rearward from the front end edge of the ground electrode 4. In the modification of FIG. 13, a cylindrical column-shaped protruding region 417 having a circular depression in the center thereof is formed at a position slightly rearward from the front end edge of the ground electrode 4.

As described above, the spark plug 100 of the present invention with good ignition performance, economy and durability can be manufactured at lower cost than ever.

Although the present invention has been described with reference to the above specific embodiments, the invention is not limited to these exemplary embodiments. Various modifications and variations of the embodiments described above will occur to those skilled in the art in light of the above teachings.

The invention claimed is:

1. A manufacturing method of a spark plug, the spark plug including: a cylindrical metal shell; a cylindrical ceramic insulator retained in the metal shell; a center electrode retained in the ceramic insulator and extending in an axial direction; and a ground electrode having a rear end portion fixed to the metal shell and a front end portion formed with a protruding region facing a front end portion of the center electrode with a gap left between the protruding region and the front end portion of the center electrode, the ground electrode being of substantially uniform thickness except for an area where the protrusion is formed, the manufacturing method comprising:

a press forming step for pressing the whole of a ground electrode material for constituting the ground electrode, so as to form a protruding region on a front end portion of the ground electrode material; and a welding step for, after the press forming step, welding a rear end portion of the ground electrode material to the metal shell.

2. The manufacturing method of the spark plug according to claim 1, wherein the ground electrode material is cut to a given length during the press forming step.

3. The manufacturing method of the spark plug according to claim 1, wherein the ground electrode material is welded to the metal shell in the welding step in a state of being held by a press die used for the press forming step.

4. The manufacturing method of the spark plug according to claim 1, further comprising: after the press forming step, a front end shaping step for processing the front end portion of the ground electrode material on which the protruding region has been formed into a given shape.

5. The manufacturing method of the spark plug according to claim 4, wherein the front end shaping step is performed by cutting lateral corners of the front end portion of the ground electrode material on which the protruding region has been formed.

6. The manufacturing method of the spark plug according to claim 1, further comprising: after the press forming step and before the welding step, an annealing step for annealing the ground electrode material.

7. The manufacturing method of the spark plug according to claim 1, further comprising: a noble metal tip joining process for joining a noble metal tip to the protruding region.

8. The manufacturing method of the spark plug according to claim 7, wherein the spark plug satisfies the following conditions: $D1<D2$ and $L1>L2$ where D1 is an outer diameter of the noble metal tip; L1 is a height of the noble metal tip; D2 is an outer diameter of the protruding region; and L2 is a height of the protruding region.

9. The manufacturing method of the spark plug according to claim 8, wherein the noble metal tip is joined to the protruding region via a fused region formed therebetween by laser welding so as to satisfy the following condition: $P>L2$ where P is a height of protrusion of the noble metal tip from the fused region.

10. A spark plug manufactured by the manufacturing method of claim 1, comprising:

a cylindrical metal shell;

a cylindrical ceramic insulator retained in the metal shell;

a center electrode retained in the ceramic insulator and extending in an axial direction; and a ground electrode having a rear end portion fixed to the metal shell, a front end portion formed with a protruding region facing a front end portion of the center electrode with a gap left between the protruding region and the front end portion of the center electrode and a noble metal tip joined to a front end of the protruding region via a fused region formed therebetween by laser welding, the ground electrode being of substantially uniform thickness except for an area where the protruding region is formed, wherein the spark plug satisfies the following conditions: $D1<D2$, $L1>L2$ and $P>L2$ where D1 is an outer diameter of the noble metal tip; L1 is a height of the noble metal tip; D2 is an outer diameter of the protruding region; L2 is a height of the protruding region; and P is a height of protrusion of the noble metal tip from the fused region.

* * * * *